United States Patent [19]

Brill et al.

[11] Patent Number: 4,614,008

[45] Date of Patent: Sep. 30, 1986

[54] SPRING BIASED CLOTHES PIN

[76] Inventors: Fred Brill; George Spector, both of 233 Broadway, Rm. 3615, New York, N.Y. 10007

[21] Appl. No.: 777,588

[22] Filed: Sep. 19, 1985

[51] Int. Cl.[4] ..... A44B 21/00

[52] U.S. Cl. ..... 24/501; 24/510; 24/530

[58] Field of Search ..... 24/510, 509, 501, 500, 24/499, 508

[56] References Cited

U.S. PATENT DOCUMENTS

| | | | |
|---|---|---|---|
| 140,659 | 7/1873 | Tunstill | 24/510 |
| 452,582 | 5/1891 | Pilkington | 24/510 |
| 743,646 | 11/1903 | Kirschbaum | 24/510 X |
| 1,284,556 | 11/1918 | Bailey | 24/501 |
| 2,333,178 | 11/1943 | Hoos | 24/510 |
| 2,496,109 | 1/1950 | Terry | 24/530 |
| 4,175,306 | 11/1979 | Bigelow et al. | 24/510 X |

*Primary Examiner*—Peter A. Aschenbrenner

[57] ABSTRACT

An improved clothes pin of the pinch type is provided wherein the improvement consists of a novel form of spring designed to place its spring action at the sides of the clothes pin which will increase the tension on the jaws of the clothes pin and prevent the two parts of the clothes pin from separating while in use.

6 Claims, 6 Drawing Figures

SPRING BIASED CLOTHES PIN

BACKGROUND OF THE INVENTION

The instant invention relates generally to clothes pins and more specifically it relates to an improved clothes pin being of a pinch type.

Numerous clothes pins have been provided in prior art that are adapted to be manually operated in open and closed positions by spring mechanisms. For example, U.S. Pat. Nos. 88,390; 2,333,178 and 2,922,209 all are illustrative of such prior art. While these units may be suitable for the particular purpose to which they address, they would not be as suitable for the purposes of the present invention as heretofore described.

SUMMARY OF THE INVENTION

A principle object of the present invention is to provide an improved clothes pin which mounts a novel form of spring thereon so that the clothes pin will not separate while in use.

Another object is to provide an improved clothes pin in which the spring is designed to place its spring action at the sides of the clothes pin which will increase the tension on the jaws of the clothes pin.

An additional object is to provide an improved clothes pin in which the spring is telescopic to accommodate various widths in the clothes pin and is also adjustable to increase the tension pressure when needed.

A further object is to provide an improved clothes pin that is economical in cost to manufacture.

A still further object is to provide an improved clothes pin that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appened claims.

BRIEF DESCRIPTION OF THE DRAWING FIGURES

FIG. 1 is a side view of the invention.

FIG. 2 an end view taken at a right angle to FIG. 1.

Figure 4:
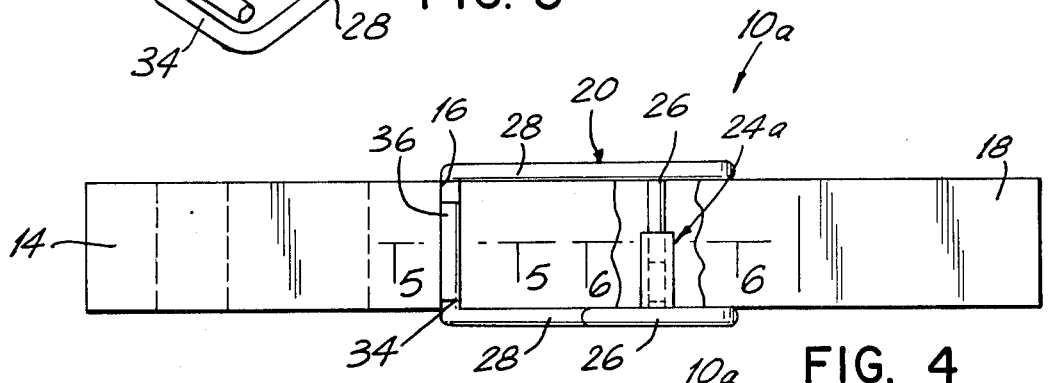
FIG. 4 is an end view similar to FIG. 2 of a modification with parts broken away showing a telescopic bar to adjust to various widths in the clothes pin and an eliptical sleeve which rotates on the arm end to increase pressure.
Figure 6:
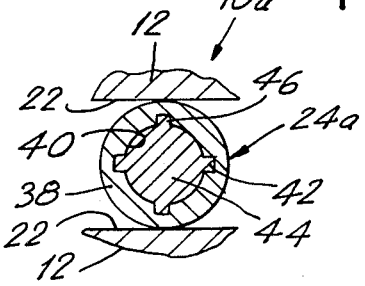

FIG. 6 an enlarged cross sectional view taken along line 6—6 in FIG. 4 of the telescopic bar.

DETAILED DESCRIPTION OF THE PREFERRED EMBODIMENTS

Figure 1:
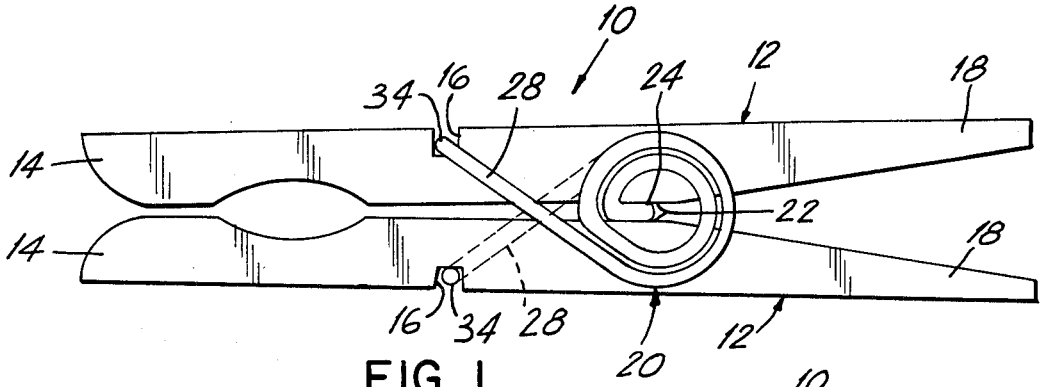
Figure 2:
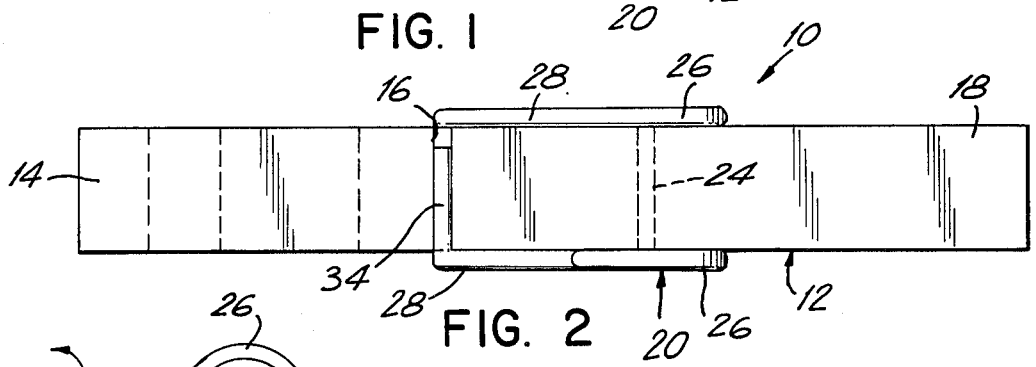

Turning now descriptively to the drawings, in which similar reference characters denote similar elements throughout the several views, FIGS. 1 and 2 illustrate an improved clothes pin 10 is the type that has a pair of complemental elongated body members 12. Each body member 12 has a front jaw 14 with a slot 16 therein and a rear outwardly inclined finger grip 18. A spring 20 is provided for resiliently pressing the jaws 14 together toward a closed position. The spring 20 has a common fulcrum at base 22 of the finger grips 18 about which the body members 12 may be rocked for opening the jaws 14 manually.

Figure 3:
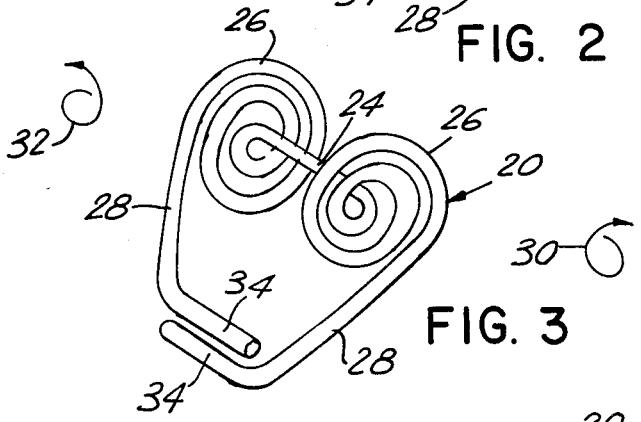
FIG. 3 is a perspective view of the spring.

The improvement consists within the spring 20 as best seen in FIG. 3 which includes an elongated bar 24 forming the common fulcrum, a pair of spiral torsion portions 26 and a pair of arms 28.

Each torsion portion 26 extends transversely from one end of the elongated bar 24 at side of the body members 12. Each arm 28 extends from one of the torsion portions 26 to engage within the slot 16. The arms 28 will embrace the jaws 14 for supplying increased tension to the body members 12 and prevent the body members from separating when using the improved clothes pin 10.

The spring 20 is made from a single piece of resilient wire in which the wire is oil tempered galvanized wire. One of the spiral torsion portions 26 spirals to the right as indicated by arrow 30 while other of the spiral torsion portions 26 spirals to the left as indicated by arrow 32 in FIG. 3. Each arm 28 is bent so that end 34 is parallel to the elongated bar 24 and extends inwardly to engage within the slot 16 of one of the body members 12.

Figure 5:
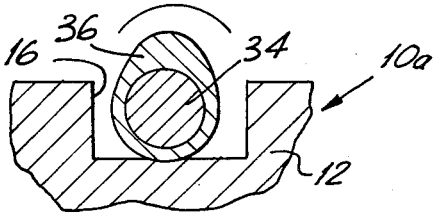
FIG. 5 is an enlarged cross sectional view taken along line 5—5 in FIG. 4 of the elipitcal sleeve.

FIGS. 4 and 5 show a modified improved clothes pin 10*a*. One of the ends 34 contains an eliptical sleeve 36 thereon that can be manually rotated on the end to increase pressure within the slot 16 of one of the body members 12.

As best seen in FIG. 6, the elongated bar 24*a* is telescopic and contains a first portion 38 that has a hollow chamber 40 with keyways 42 therein. A second portion 44 has keys 46 and is of a specific size to fit within the hollow chamber 40 so that the keys 46 can slide within the keyways 42 preventing circumferential movement of the first portion 38 with the second portion 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved clothes pin of the type having a pair of complimental elongated body members, each body member having a front jaw with a slot therein and a rear outwardly inclined finger grip and a spring for resiliently pressing said jaws together toward a closed position, said spring having a common fulcrum at the base of said finger grips about which said body members may be rocked for opening said jaws manually, wherein the improvement comprises said spring including:

(a) an elongated bar forming said common fulcrum;

(b) a pair of spiral torsion portions, each said torsion portion extending transversely from one end of said elongated bar at side of said body members; and (c) a pair of arms, each said arm extending from one of said torsion portions to engage within said slot so that said arms will embrace said jaws for supplying increased tension to said body members and preventing said body members from separating when using said improved clothes pin.

2. An improved clothes pin as recited in claim 1, wherein said spring is made from a single piece of resilient wire in which said wire being oil tempered galvanized wire.

3. An improved clothes pin as recited in claim 2, wherein one of said spiral torsion portions spirals clockwise while other of said spiral torsion portions spirals to the counterclockwise relative to the longitudinal axis of the elongated fulcrum bar.

4. An improved clothes pin as recited in claim 3, wherein each of said arms is bent so that end is parallel to said elongated bar and extends inwardly to engage within said slot of one of said body members.

5. An improved clothes pin as recited in claim 4, wherein one of said ends comprises an eliptical sleeve thereon that can be manually rotated on said end to increase pressure within said slot of one of said body members.

6. An improved clothes pin as recited in claim 5, wherein said elongated bar is telescopic and comprises:

(a) a first portion having a hollow chamber with a keyway therein; and (b) a second portion having a key and being of a specific size to fit within said hollow chamber so that said key can slide within said keyway preventing circumferential movement of said first portion with said second portion.

* * * * *